US009999795B1

(12) United States Patent
Jarosz et al.

(10) Patent No.: US 9,999,795 B1
(45) Date of Patent: Jun. 19, 2018

(54) MOTORIZED ROTATABLE EXERCISE POLE

(71) Applicants: Katarzyna Lucja Jarosz, Astoria, NY (US); Stella Fink, Bayside, NY (US)

(72) Inventors: Katarzyna Lucja Jarosz, Astoria, NY (US); Stella Fink, Bayside, NY (US)

( * ) Notice: Subject to any disclaimer, the term of this patent is extended or adjusted under 35 U.S.C. 154(b) by 57 days.

(21) Appl. No.: 15/379,681

(22) Filed: Dec. 15, 2016

(51) Int. Cl.
*A63B 9/00* (2006.01)
*A63B 21/00* (2006.01)
*A63B 21/16* (2006.01)

(52) U.S. Cl.
CPC ..... *A63B 9/00* (2013.01); *A63B 21/1681* (2013.01); *A63B 2244/225* (2013.01)

(58) Field of Classification Search
CPC . A63B 2244/225; A63B 9/00; A63B 21/1627; A47G 33/126; A47G 2007/048; A47F 5/025; F16M 11/08; A45B 2017/005
See application file for complete search history.

(56) References Cited

U.S. PATENT DOCUMENTS

| | | | | |
|---|---|---|---|---|
| 3,456,519 | A | 7/1969 | Anderson | |
| 3,923,001 | A | 12/1975 | Murdock | |
| 5,112,019 | A | 5/1992 | Metzler et al. | |
| 5,146,861 | A | 9/1992 | Sato et al. | |
| 5,255,886 | A * | 10/1993 | Wang | A47G 33/126 248/349.1 |
| 5,673,862 | A | 10/1997 | Wingler | |
| 6,200,189 | B1 | 3/2001 | Coleman et al. | |
| 8,137,243 | B2 * | 3/2012 | Coote | A63B 9/00 248/354.1 |
| 8,672,496 | B2 | 3/2014 | O'Kane | |
| 2008/0070753 | A1 * | 3/2008 | Suida | A63B 9/00 482/33 |
| 2008/0146423 | A1 | 6/2008 | Ammon et al. | |
| 2010/0179029 | A1 * | 7/2010 | Ochi | A63B 9/00 482/35 |
| 2017/0282045 | A1 | 10/2017 | Glasner et al. | |
| 2017/0318919 | A1 * | 11/2017 | Gharabegian | A45B 17/00 |

FOREIGN PATENT DOCUMENTS

| | | |
|---|---|---|
| WO | 9913244 | 3/1999 |
| WO | 2005049967 | 6/2005 |
| WO | 2014110658 | 7/2014 |

OTHER PUBLICATIONS 14e festival de cirque de Rhône-Alpes (Voiron)—Karen et Dominic—Les drapeaux humains, https://www.youtube.com/watch?v=usVkT4km20w, Nov. 23, 2015.

* cited by examiner

*Primary Examiner* — Joshua Lee
*Assistant Examiner* — Jennifer M Deichl
(74) *Attorney, Agent, or Firm* — Lambert & Associates; Gary E. Lambert; David J. Connaughton, Jr.

(57) ABSTRACT

A motorized rotational dance pole assembly is provided. The dance pole can be rotated by an adjustable and controllable motor assembly to provide controlled rotation of the pole at varying speeds. Further, the pole may have a fixed non-rotating mode, as well as a free rotational mode. Operation of the motorized rotational dance pole may be controlled by a remote wireless controller which may be programmable and reprogrammable to adjust operation of the dance pole.

20 Claims, 3 Drawing Sheets

MOTORIZED ROTATABLE EXERCISE POLE

BACKGROUND OF THE INVENTION

Field of the Invention

The present invention relates generally to dance or exercise poles. More particularly the present invention relates to a motorized rotatable exercise pole having an adjustable motor assembly for attachment to the pole.

Description of Related Art

The use of dance exercise poles for dance, sport, recreation and fitness has become popular in recent years. These poles extend between a floor and ceiling attachment and can be erected and dismantled at various sites. They may also be set on a portable, demountable, moveable stage and may have no fixed floor and ceiling attachment.

Dance exercise poles can have two modes of use; static or spinning. While in static mode, the dance exercise pole does not rotate relative to its floor and ceiling connectors.

To set the pole on spinning mode, a means for blocking pole rotation relative to its floor and ceiling connectors is disengaged, allowing the pole to rotate freely relative to its floor and ceiling connectors.

During rotation of the pole relative to its floor and ceiling connectors, rotation speed varies depending on several factors, including, but not limited to, tightness of various pole screws, force applied onto the pole by the user, and centrifugal force of the user's body weight. For such reasons, the speed of the rotating pole is not ideally predictable or ideally controllable, and subject to continuous variation during pole use. Another disadvantage is that unless new momentum is continually applied, the pole eventually ceases to rotate during use.

Therefore, what is needed is an easily adjustable, removable, interchangeable, and/or demountable exercise pole and motor assembly that may be adjustable for programs, direction, speed, and/or may be controlled remotely.

SUMMARY OF THE INVENTION

The subject matter of this application may involve, in some cases, interrelated products, alternative solutions to a particular problem, and/or a plurality of different uses of a single system or article.

In one aspect, a motorized dance pole assembly is provided. The assembly has a dance pole which has a ceiling connector and a floor connector. However, in varying embodiments, the dance pole may be connected only to one or the ceiling and the floor. The dance pole is rotatable with respect to the ceiling connector and floor connector. The assembly also has a motor assembly that is configured to provide rotation to the dance pole by mechanical connection to the dance pole. A remote controller is in communication with the motor assembly. This controller is capable of sending signals to the motor assembly to cause it to provide a first rotation at a first speed of the dance pole, a second rotation at a second speed of the dance pole, a fixed non rotational pole mode, and a free rotational pole mode. In various aspects, the present invention may be applied to any sort of exercise equipment without straying from the scope of the present invention. For example, exercise equipment may herein refer to a dance pole, a large hoop, a hook shaped exercise dance structure, and any other structure that may be used as a dancing support structure.

Further, the motor assembly may comprise an electrically powered motor that has an output shaft connected to a gear box. A wheel may be connected to an output shaft of the gear box. A belt may be connected to this wheel and connected to the pole, thereby providing a mechanical connection between the two. Upon rotation of the wheel, the belt is moved, which in turn may move the pole. In another aspect, a chain and toothed gear assembly may replace the belt and wheel configuration.

DETAILED DESCRIPTION

Figure 1:
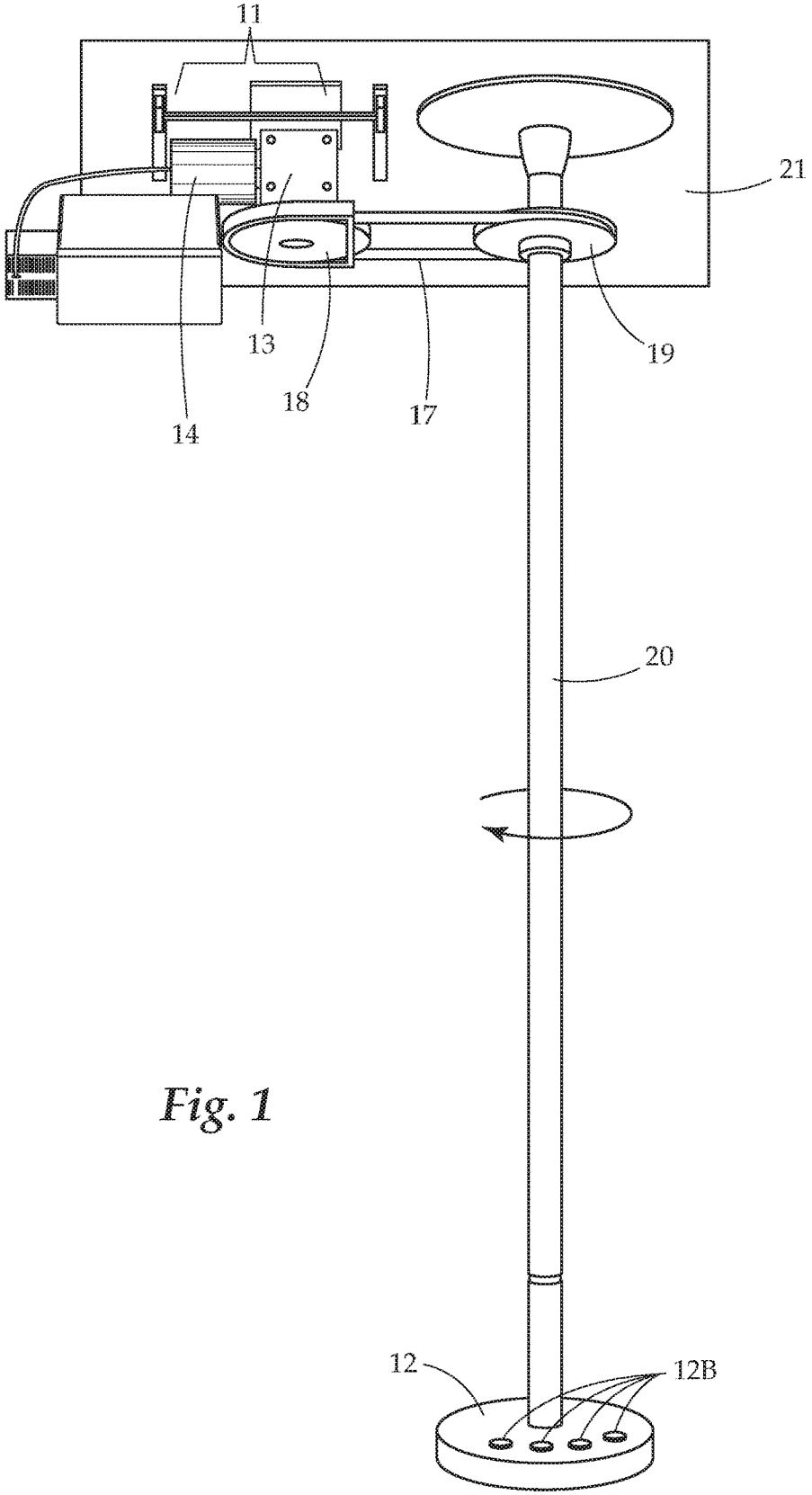
FIG. 1 provides a view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a motorized dance pole that may utilize the motor to control rotation of the pole relative to floor and ceiling connectors. The dance pole of the present invention further has the ability for a fixed mode, a freely rotatable mode, and a controlled rotation mode. A controller may allow the motor to control rotation at a number of various rates, stop rotation, and allow free rotation. In some cases, a motor assembly may be mountable to an existing dance pole to provide an enhancement to existing dance poles or similar gymnastics equipment.

The motor assembly of the present invention allows controlled rotation of the dance pole relative to the floor and/or ceiling to which it is mounted. This motor assembly, in some embodiments, may be remotely controllable such that a rotational speed may be adjusted between multiple settings. However, in other embodiments, a single speed may be provided without straying from the scope of this invention.

The controller may have, for example, a microprocessor that is programmed to provide outputs to control the motor operation upon receiving certain inputs, such as button or touch screen inputs.

The controller may have a plurality of pre-programmed settings for various control modes. The remote controller may be a specially designed device, or may be a computerized device having a networked connection with a wireless controller on the motor. Examples of computerized devices to control rotation operation of the dance pole include smart phones, tablet computers, laptop computers, and desktop computers, among others. In some embodiments, adjustments to a pre-set controller function, such as a rotational speed, can be made by reprogramming the remote controller or its components (computer software, microprocessor, computer memory, or the like). In some embodiments, the controller may further include a control deactivator which may turn off the function of other controller buttons or inputs to prevent accidental changes being applied during dance pole use. Further still, control may be achieved by voice-activation using a microphone in communication with a computerized controller or remote controller which is programmed to receive voice inputs.

In one embodiment, the rotatable pole may have an emergency stop feature that can halt pole rotation rapidly. This may be provided on the remote controller, a secondary controller, or directly on the motor assembly, among other arrangements.

The motor may be configured to rotate the pole at any number of various rotational speeds. For example, the motor may be configured to rotate the pole at rotational speeds of 15 revolutions per minute (rpm); 10 rpm; 25 rpm; 30 rpm; 40 rpm, and so on. Further, in some embodiments, multiple rotational speeds may be available, wherein the motor may be capable of all three of 15, 25, and 40 rpm. As noted above, in embodiments having multiple rotational speeds the system may optionally also have a controller which is programmable and reprogrammable to control for multiple different rotational speeds. For example, speed 1 may initially correspond to 25 rpm, but may be changed later to a new rotational speed such as 15 rpm. Spin direction may also be controlled by the motor and/or remote controller. Further still, the controller may be programmable and reprogrammable to communicate with various different motor systems. In one embodiment, the controller may be pre-programmed to operate with a first motor, but may be reprogrammed to operate with a second different motor.

The motor assembly may connect to and control movement of the pole in any manner. Further, this motor assembly may be permanently integrated into the dance pole, may be removable, or may be an add-on to existing dance poles.

In a particular embodiment, the controller may be fixedly or removably positioned on a bottom of the pole adjacent to the floor. In a particular embodiment, this bottom-mounted controller may be positioned to surround a bottom of the pole. On this controller are a plurality of buttons which, through wireless communication with the motor assembly, can control the dance pole to be in the fixed mode, free rotation mode, or controlled motorized rotation mode. In a particular embodiment, the buttons may be large, spaced apart buttons that can be activated with a user's toes. In some cases, they may be concave and/or recessed into the surface of the base, so as to prevent accidental pushing. Also, the buttons of the controller may control rotational speed. Positioning this controller by the base of the pole allows a dancing user to quickly, easily, and subtly control operation of the dance pole. In a further embodiment, the controller may be easily detachable from the base of the dance pole by being formed of one or more sections that can lock into each other around the base of the pole, resting flush along the pole base. The base, in some embodiments may have a cover that may cover a plurality of the control buttons.

In some controller embodiments, there may be a lag time in changing or activating the different modes so as to limit unintended changes caused by accidental controller operation.

Turning now to FIG. 1, an embodiment of the present invention is provided. A dance pole 20 extends from a floor to a ceiling. This dance pole 20 is capable of being in a fixed, non-rotational mode, a freely rotational mode, which spins upon application of a force causing it to rotate, and a motor-controlled rotation mode such that it rotates as controlled by a rotation of a motor.

A motor assembly 11 is mounted to a ceiling 21 and positioned to control a rotation of the pole 20. The motor assembly 11 comprises a motor 14, gear box 13, and a wheel 18 which is rotated by the motor 14 through the gear box 13. This motor may be a motor having an output shaft, or a custom made gear motor with a shaft, or any other motive device. A belt (or chain) 17 is connected to the motor wheel 18 as well as to the pole 20 at disc 19. The disc 19 is either permanently or removably connected to the pole 20 and provides an area with a greater circumference from the pole 20 to receive the belt 17. In other embodiments however it should be understood that the belt 17 may be wrapped directly about the pole 20.

In other varying embodiments, any structure that may join the rotatable pole to the motor may be used. For example, in addition to belts and chains, a direct gear connection may join the rotatable pole to the motor: one gear on a drive output of the motor connected to a gear on the pole. In a geared connection, a first gear can be connected to a drive shaft of the motor, and a second gear can be connected to the pole. Upon rotation of one gear, when the gear teeth are engaged with each other, the opposing gear will also be rotated. In yet another embodiment, a magnetic connection may join the wheel and disc.

At a bottom of the pole 20 is a controller 12. The controller is in wireless communication with the motor assembly 11 and is configured to control motor 14 speed which in turn controls pole 20 rotational speed. In this embodiment, the controller wraps about a bottom of the pole 20. In some cases, attachable pieces may connect to make the controller 12 removable. A plurality of buttons **12*b* are on the controller 12 and allow inputs that instruct a processor of the controller 12 to signal operations to the motor 14**.

In this embodiment, the belt 17 may be prevented from slipping from the wheel 18 or disc 19 by tension between the belt and wheel 18 and between the belt 17 and disc 19. This tension, in some embodiments, may be adjusted such that the tension may be removed from the belt, allowing free rotation of the pole 20. In other embodiments, free rotation may be achieved by a disconnection of the wheel 18 from the gear box to allow free rotation of the wheel 18. In either case, free rotation may in some embodiments be activated using the controller 12 whether mounted to a bottom of the pole 12 or remote. In some embodiments, the tension of the belt 17 can be loosened slightly in a controlled manner to allow for an amount of slippage between the belt 17 and disc 19.

Figure 2:
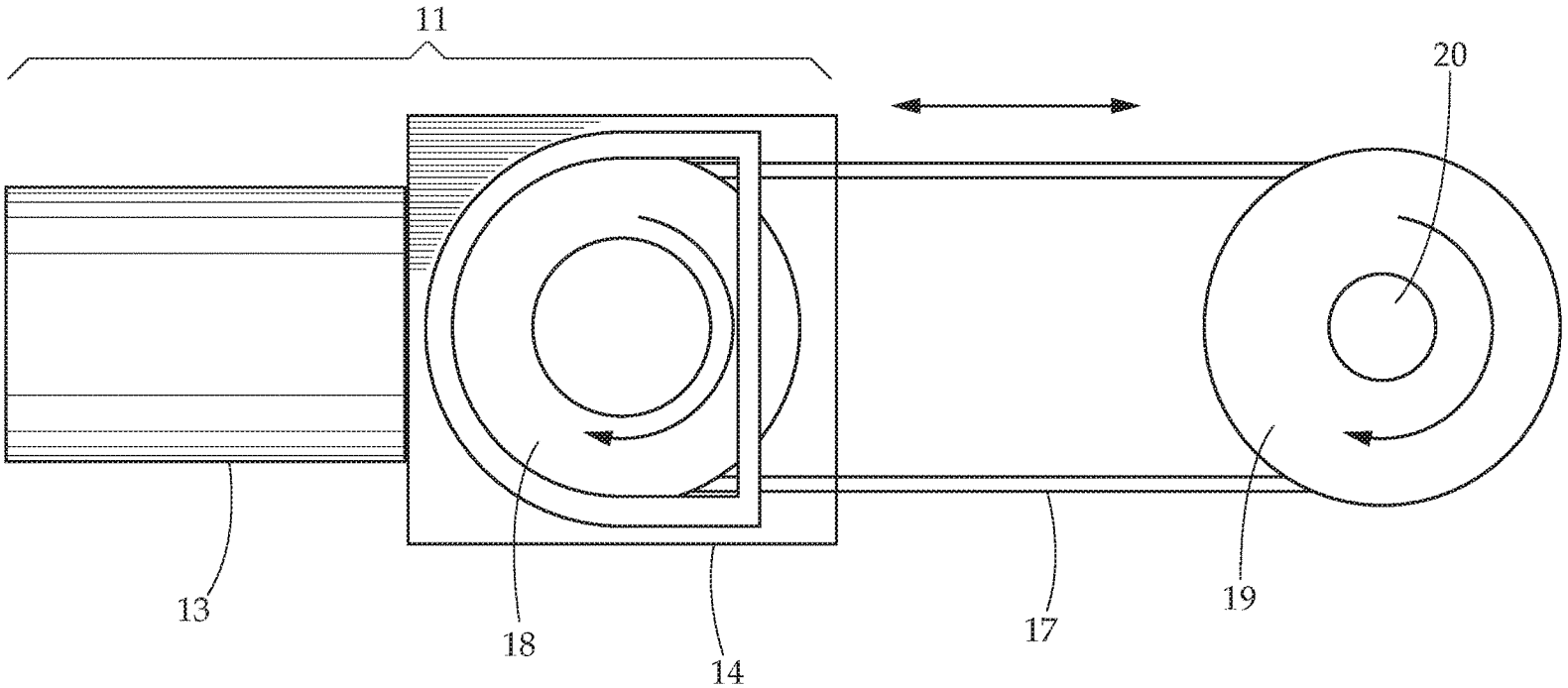
FIG. 2 provides a bottom view of an embodiment of the present invention.

FIG. 2 provides a bottom view of an embodiment of the motor assembly connected to the pole. In this view, pole 20 extends out of the page. The motor assembly 11, having motor 14 and gear box 13 is seen connected to wheel 18. Wheel is rotatable as indicated, and also may be rotated in the opposite direction. As indicated by arrow 16, the wheel 18 may be moved laterally towards and away from the pole 20 to loosen or provide tension to the belt 17. Proper tension on the belt 17 ensures there is not slippage between belt 17, wheel 18, and disc 19. In embodiments using chains, proper tension ensures that the chain remains engaged with the teeth of the wheel 18 and/or disc 19. Movement 16 of the wheel 18 may be achieved in any manner without straying from the scope of this invention. The lateral movement 16 may be motorized and controllable by the remote controller, or may be manually controlled. Further, lateral movement 16 may be of the wheel 18 directly, of the gearbox 13 which in turn moves the wheel; or of the entire motor assembly 11.

Figure 3:
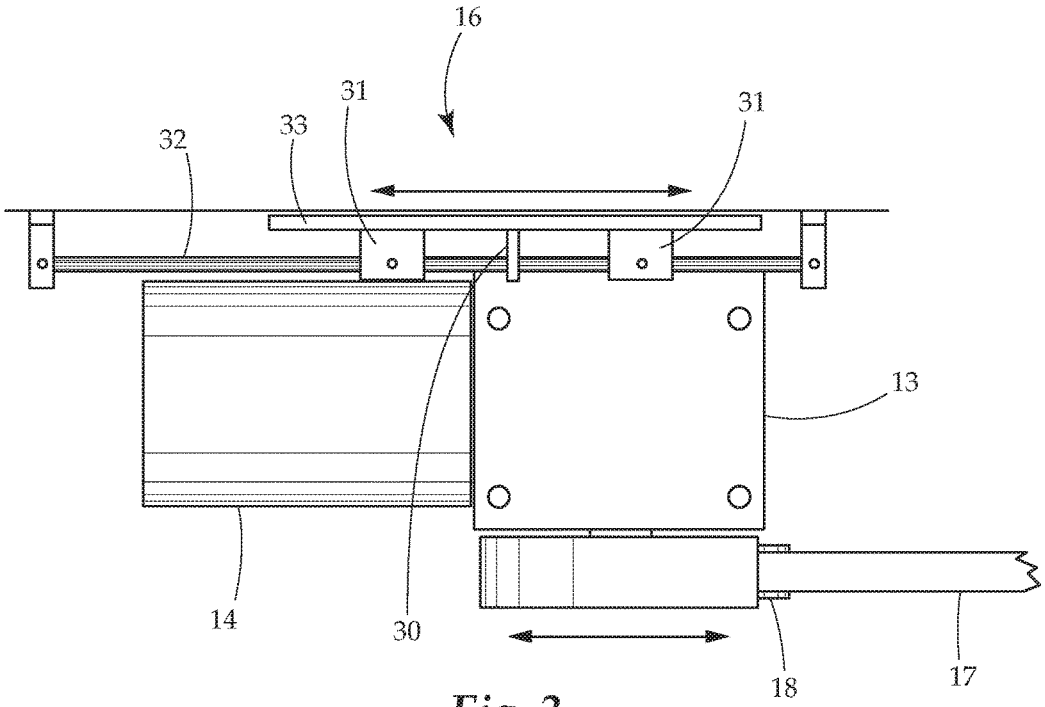
FIG. 3 provides a side view of an embodiment of the present invention.

FIG. 3 provides a view of an embodiment of the motor assembly having a laterally adjustable gear box, which may also involve a laterally adjustable motor. In this view, a fixed bar 32 is connected to plate 33. Connectors 31 slideably connect the gear box 13 to the bar 32. Movement of the connectors 31 along the bar 32 cause movement of the wheel 18, which in turn increases or decreases tension on the belt 17. The movement of the connectors 31 may be controlled by a motor (not shown) which in turn may be activated by a remote controller. A position sensor 30 may be utilized to determine the location of the wheel 18 and its tensioning status. The controller may be programmed to associate the determined location by the position sensor to identify if the wheel 18 is in a tensioned position or a loose position allowing removal or free movement of the pole.

Figure 4:
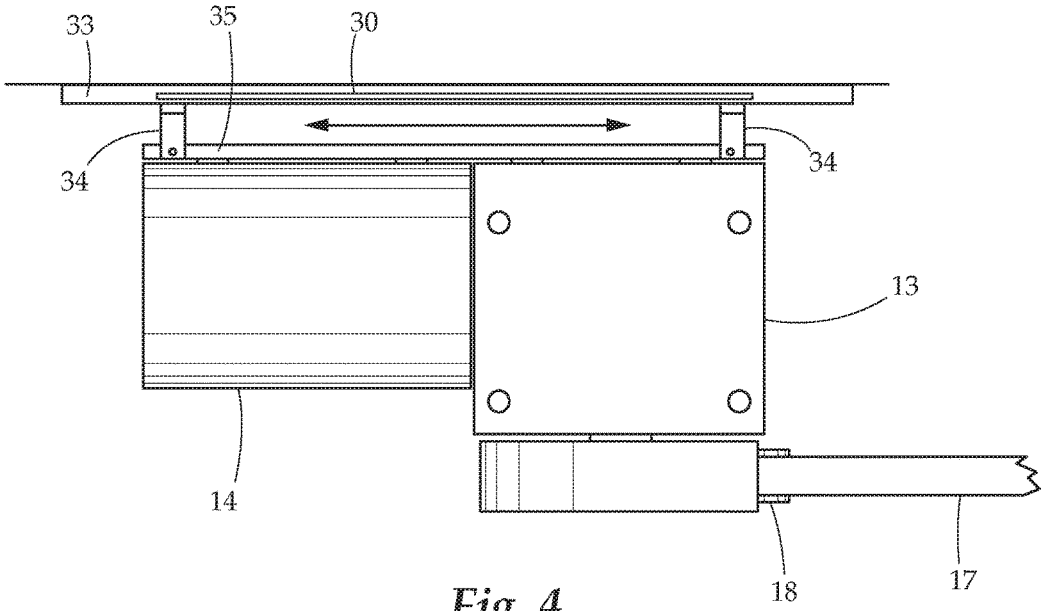
FIG. 4 provides a side view of another embodiment of the present invention.

FIG. 4 provides another embodiment of the motor assembly being laterally adjustable. In this view, motor 14 and gear box 13 are connected to a motor mount plate 35. Connectors 34 extend from the motor mount and are slideably connected to the base plate 33, allowing the motor mount 35 to slide lengthwise with respect to the base plate 33. A position sensor strip 30 is positioned on the base plate 33. This strip may electronically monitor a location of the motor mount 35 and in turn the wheel 18, as well as a tensioning status of the belt 17 connected to the wheel 18. The controller may be programmed to associate the determined location by the position sensor strip 30 to identify if the wheel 18 is in a tensioned position or a loose position allowing removal or free movement of the pole.

It is to be understood that the movement embodiments of FIGS. 3 and 4 are merely illustrative, and many other similar embodiments are within the scope of this invention. Indeed any structure that allows movement to loosen or tighten the belt anywhere along the connection path of the belt/chain (in embodiments using a belt/chain), and wheel relative to disc may be used without straying from this invention.

In some embodiments, the controller may be pre-programmed or programmable to change rotational speeds and/or stop rotation and/or allow free rotation at different time periods. For example, a rotation program may be developed to correspond to a song or series of songs. At different programmed times in the song, the pole operation may change. For example, as a song gets faster, rotation speed may increase. Or, when switching from a fast song to a slow song, rotational speed may decrease.

In an embodiment of use, the motor assembly may be mounted onto a ceiling or similar dance pole support structure adjacent to the dance pole. A movement structure such as the belt or chain noted above, or other structure capable of rotating the pole is connected to the pole to mechanically join the pole and motor assembly. These steps may be performed on existing exercise poles, or may be performed during manufacture of the pole as part of a built-in motorized exercise pole system. As noted, the above noted belt/chain system of mechanized movement may require a proper tensioning of the belt and calibration to identify a position of the motor wheel to be in a tensioned position and a free position removing tension from the belt. It should be understood that in most embodiments, the pole may be rotatable relative to a floor connection and/or a ceiling connection by, for example, a bearing or other rotatable connection joining the pole to the floor connection and/or ceiling connection.

The controller may be calibrated and/or programmed to control motor operation and pole rotational speed. The controller, as noted above, may be any sort of remote controller, and in a particular embodiment, may be removably or permanently attached to a base of the dance pole. Depending on configuration, a single button on the controller may cycle through various increasing rotational speeds, or a single button may correspond to a particular rotational speed. Further, the controller may be capable of changing the direction of spin. In further embodiments, a separate deactivation controller may be wirelessly communicating with the motor separately from the controller which may deactivate operation of the primary controller when in use.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A motorized dance pole assembly comprising:

a dance pole having at least one of a ceiling connector and a floor connector, the dance pole rotatable with respect to the ceiling connector and floor connector;

a motor assembly configured to provide rotation to the dance pole;

a controller, the controller having a first transceiver in wireless communication with a second transceiver of the motor assembly, the controller capable of causing the motor assembly to provide a first rotation at a first speed of the dance pole, a second rotation at a second speed of the dance pole, a fixed non rotational pole mode, and a free rotational pole mode.

2. The motorized dance pole assembly of claim 1 wherein the motor assembly further comprises a gear motor.

3. The motorized dance pole assembly of claim 1 further comprising one of a belt and a chain connected to a wheel of the motor assembly and connected to the pole, such that upon a rotation of the wheel by the motor, the one of the belt and the chain causes a rotation of the pole.

4. The motorized dance pole assembly of claim 3 wherein the pole further comprises a disc at a top of the pole adjacent to the motor assembly, the disc being a region having a greater diameter than the pole, the motor assembly connected to the pole at the disc by one of the belt/chain.

5. The motorized dance pole assembly of claim 1 further comprising a geared connection of the wheel to the pole.

6. The motorized dance pole assembly of claim 3 wherein a lateral distance of the wheel relative to the pole is adjustable.

7. The motorized dance pole assembly of claim 3 wherein a lateral distance of the motor assembly relative to the pole is adjustable.

8. The motorized dance pole assembly of claim 6 further comprising a secondary motor, the secondary motor providing movement of the wheel closer to the pole.

9. The motorized dance pole assembly of claim 1 wherein the controller is programmable to set the first speed of the dance pole and the second speed of the dance pole.

10. The motorized dance pole assembly of claim 1 wherein the controller is programmable and reprogrammable to set the first speed of the dance pole and the second speed of the dance pole, and to change the first speed of the dance pole and the second speed of the dance pole once set to different rotational speeds.

11. The motorized dance pole assembly of claim 1 wherein the pole further comprises a disc at a top of the pole adjacent to the motor assembly, the disc being a region having a greater diameter than the pole, the motor assembly connected to the pole at the disc.

12. The motorized dance pole assembly of claim 1 wherein the controller is positioned at a base of the pole adjacent to a floor connector of the at least one of the ceiling connector and the floor connector.

13. The motorized dance pole assembly of claim 1 wherein the controller comprises a plurality of buttons, one of the plurality of buttons configured to cause the pole to be in one of the first rotation at the first speed of the dance pole, the second rotation at the second speed of the dance pole, the fixed non rotational pole mode, and the free rotational pole mode.

14. The motorized dance pole assembly of claim 1 wherein the controller is a computerized device in wireless communication with the motor assembly.

15. The motorized dance pole assembly of claim 1 comprising both the ceiling connector and the floor connector, and wherein the ceiling connector is connected to a building ceiling; and wherein the floor connector is connected to a building floor.

16. The motorized dance pole assembly of claim 15 wherein the motor assembly is directly connected to one of the building ceiling and the building floor.

17. The motorized dance pole assembly of claim 1 wherein the controller is further configured to cause rotation of the pole in a first direction, and in a second opposite direction.

18. The motorized dance pole assembly of claim 1 wherein the controller is a voice controller.

19. The motorized dance pole assembly of claim 1 wherein the dance pole is an existing dance pole, and wherein the motor assembly is portable and removably attached to the dance pole.

20. The motorized dance pole assembly of claim 1 wherein the motor assembly is permanently attached to the pole, and wherein the pole and motor assembly are integrally formed.

* * * * *